US009564711B2

(12) United States Patent
Tanaka et al.

(10) Patent No.: US 9,564,711 B2
(45) Date of Patent: Feb. 7, 2017

(54) CONNECTOR HAVING AN OPERATION MEMBER AND A LOCKING MEMBER

(71) Applicant: JAPAN AVIATION ELECTRONICS INDUSTRY, LIMITED, Shibuyaku, Tokyo (JP)

(72) Inventors: Yukitaka Tanaka, Tokyo (JP); Chikara Kawamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/099,273

(22) Filed: Apr. 14, 2016

(65) Prior Publication Data

US 2016/0359273 A1 Dec. 8, 2016

(30) Foreign Application Priority Data

Jun. 4, 2015 (JP) ..... 2015-113586

(51) Int. Cl.
*H01R 13/62* (2006.01)
*H01R 13/633* (2006.01)
*H01R 13/627* (2006.01)

(52) U.S. Cl.
CPC ..... *H01R 13/6335* (2013.01); *H01R 13/6272* (2013.01)

(58) Field of Classification Search
USPC ..... 439/151, 153, 157, 160
See application file for complete search history.

(56) References Cited

U.S. PATENT DOCUMENTS 7,114,980 B1 * 10/2006 Wu ..... H01R 13/6275 439/352
7,134,914 B1 * 11/2006 Wu ..... H01R 13/5804 439/357
7,281,937 B2 * 10/2007 Reed ..... H01R 13/6275 439/352
7,354,292 B1 4/2008 Lloyd et al.
8,500,470 B2 * 8/2013 Wang ..... G02B 6/4261 385/53
2007/0037437 A1 * 2/2007 Wu ..... H01R 13/6335 439/449
2007/0049082 A1 * 3/2007 Wu ..... H01R 13/6596 439/160

(Continued)

FOREIGN PATENT DOCUMENTS

JP 2009543296 A 12/2009

*Primary Examiner* — Chandrika Prasad
(74) *Attorney, Agent, or Firm* — Holtz, Holtz & Volek PC

(57) ABSTRACT

A connector reduced in dimension in a front-rear direction by reducing the distance between an operating portion of an operation member and hooking portions of a locking member. The locking member maintains a state of a housing fitted to a mating housing, and includes a body, hooking portions provided at respective free end-side portions of the body, for being hooked to the mating housing to thereby maintain the fitted state, and a transmission portion for transmitting a force to move the operation member toward the rear of the housing, to the body, to thereby displace the hooking portions away from the mating housing. The operation member includes an operating portion for applying the force to the transmission portion. These portions are each formed with a flat surface inclined in a manner approaching the housing as it extends toward the rear of the housing.

16 Claims, 9 Drawing Sheets

(56) References Cited

U.S. PATENT DOCUMENTS

| | | | | |
|---|---|---|---|---|
| 2007/0232118 | A1* | 10/2007 | Wu | H01R 13/6275 439/353 |
| 2010/0216325 | A1* | 8/2010 | Huang | H01R 13/6275 439/155 |
| 2012/0052712 | A1* | 3/2012 | Wang | H01R 13/6335 439/352 |
| 2013/0126672 | A1* | 5/2013 | Weitzel | B64D 11/06 244/118.6 |

* cited by examiner

CONNECTOR HAVING AN OPERATION MEMBER AND A LOCKING MEMBER

BACKGROUND OF THE INVENTION

Field of the Invention

This invention relates to a connector.

Description of the Related Art

Conventionally, as shown in FIGS. 8 and 9, there has been proposed a plug connector 910 comprised of a connector housing 912, as actuator 960, and a latch arm 942 (see Japanese Translation of PCT International Application Publication No. 2009-543296).

The connector housing 912 includes a front part 920 and a body 928. A top surface 930 of the body 928 is at a location higher than a top surface 924 of the front part 920, and an inclined surface 940 which is inclined toward the top surface 924 of the front part 920 is provided at a front-side portion of a bottom portion 934 of the top surface 930 of the body 928.

The actuator 960 is disposed on the top surface 930 of the body 928 in a manner slidable in a front-rear direction of the connector housing 912. An end portion 954 at a front-side portion of the actuator 960 is formed into a hollow cylindrical shape.

One end of the latch arm 942 is fixed to a rear portion of the top surface 930 of the body 928. A free end portion of the latch arm 942 is provided with hooks 956 which can be hooked into slits 957 of a guide frame 922 which surrounds a mating receptacle connector (not shown).

A free end-side portion of the latch arm 942 is provided with an inclined segment 952 which is inclined toward the top surface 924 of the front part 920. The inclined segment 952 and the inclined surface 940 of the body 928 of the connector housing 912 are substantially parallel to each other, and a space for accommodating the end portion 954 of the actuator 960 is formed between the inclined segment 952 and the inclined surface 940.

When a rear end portion of the actuator 960 is pulled backward, the end portion 954 of the actuator 960 is slid upward along the inclined surface 940 of the body 928, and pushes a middle portion 948 of the latch arm 942. As a result, the latch arm 942 is elastically deformed upward, and the hooks 956 are removed from the slits 957 of the guide frame 922, whereby the connector housing 912 and the mating receptacle connector are released from the locked state.

As described above, since the latch arm 942 is provided with the inclined segment 952, it is difficult to reduce the distance between the hooks 956 of the latch arm 942 and the end portion 954 of the actuator 960.

This causes a problem that a dimension of the plug connector 910 in the front-rear direction is increased.

SUMMARY OF THE INVENTION

The present invention has been made in view of these circumstances, and an object thereof is to reduce a dimension of a connector in a front-rear direction by making it possible to reduce the distance between an operating portion of an operation member and a hooking portion of a locking member.

To attain the above object, the present invention provides a connector including a housing that can be fitted to a mating connector, a locking member mounted on the housing, for maintaining the housing in a state fitted to the mating connector, and an operation member mounted on the housing in a manner movable along a front-rear direction of the housing, for operating the locking member such that a locked state in which the fitted state of the housing to the mating connector is maintained is released, wherein the locking member comprises a locking member body that is mounted on the housing in a cantilever manner, a fixing portion that is provided at a fixed end-side portion of the locking member body, and is fixed to the housing, a hooking portion provided at a free end-side portion of the locking member body, for being hooked to the mating connector to thereby maintain the locked state, and a transmission portion provided between the fixing portion and the hooking portion of the locking member body, for transmitting a force to move the operation member toward a rear of the housing, which is a direction away from the mating connector, to the locking member body, causing elastic deformation of the locking member body, thereby displacing the hooking portion in a direction away from the mating connector, to release the locked state, wherein the operation member comprises an operating portion that applies the force to move the operation member toward the rear of the housing to the transmission portion, and wherein at least one of a portion of the transmission portion, which is brought into contact with the operating portion, and a portion of the operating portion, which is brought into contact with the transmission portion, is formed with a surface inclined in a manner approaching the housing as the surface extends toward the rear of the housing.

Preferably, the surface is a flat surface.

Preferably, the locking member is integrally formed by bending a plate-shaped member.

Preferably, the operation member includes a pulling portion for pulling the operating portion toward the rear of the housing.

More preferably, the operation member includes a connection portion that connects the operating portion and the pulling portion, and the connection portion is formed with an accommodating space for accommodating part of the transmission portion.

Further preferably, the operating portion, the connection portion, and the pulling portion are integrally formed of the same material.

According to the present invention, it is possible to reduce the distance between the operating portion of the operation member and the hooking portions of the locking member, and hence it is possible to reduce a dimension of the connector in the front-rear direction.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 6:
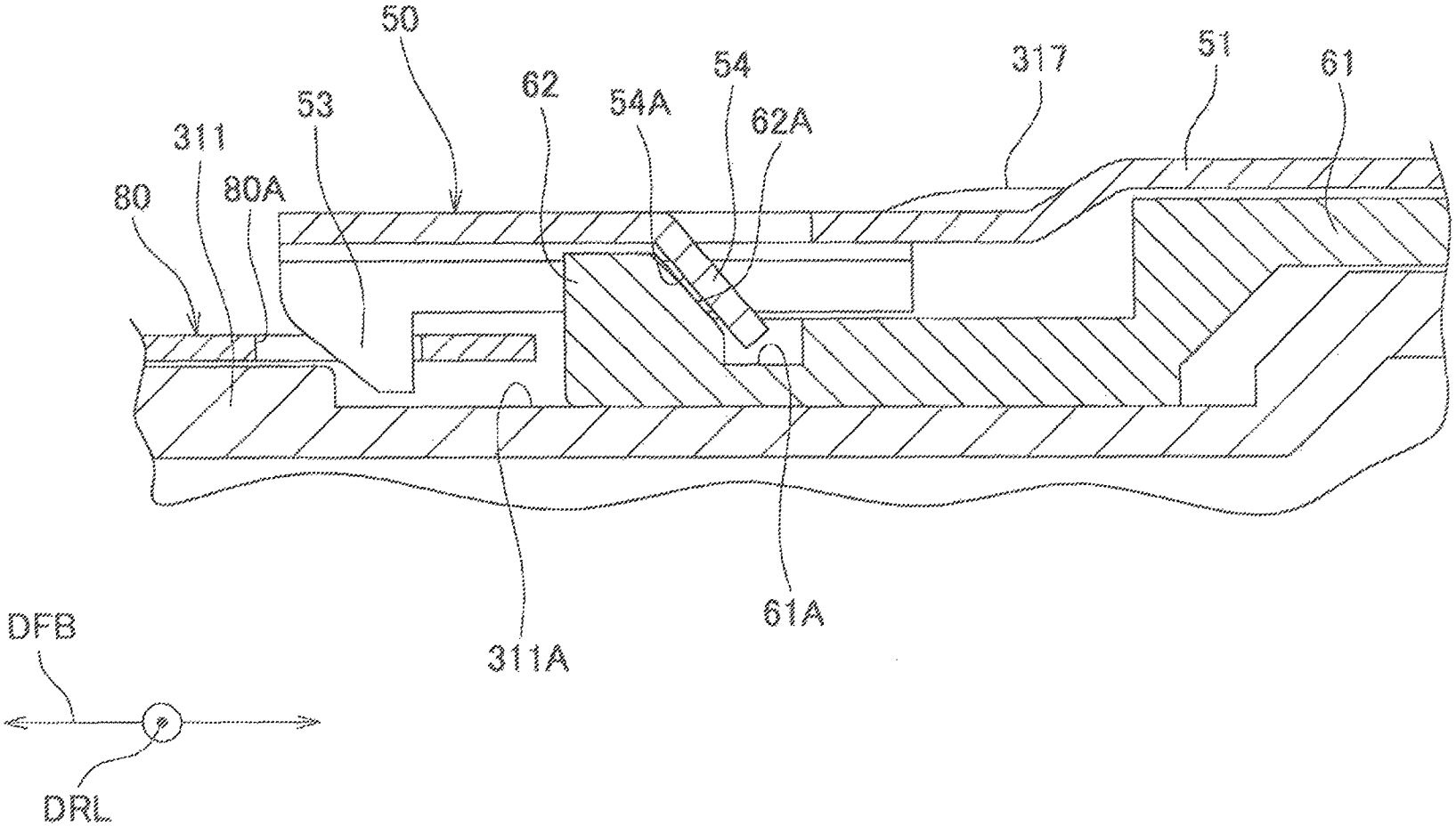
FIG. 6 is a partial cross-sectional view showing a state in which the connector shown in FIG. 1 is locked to a mating connector.
Figure 7:
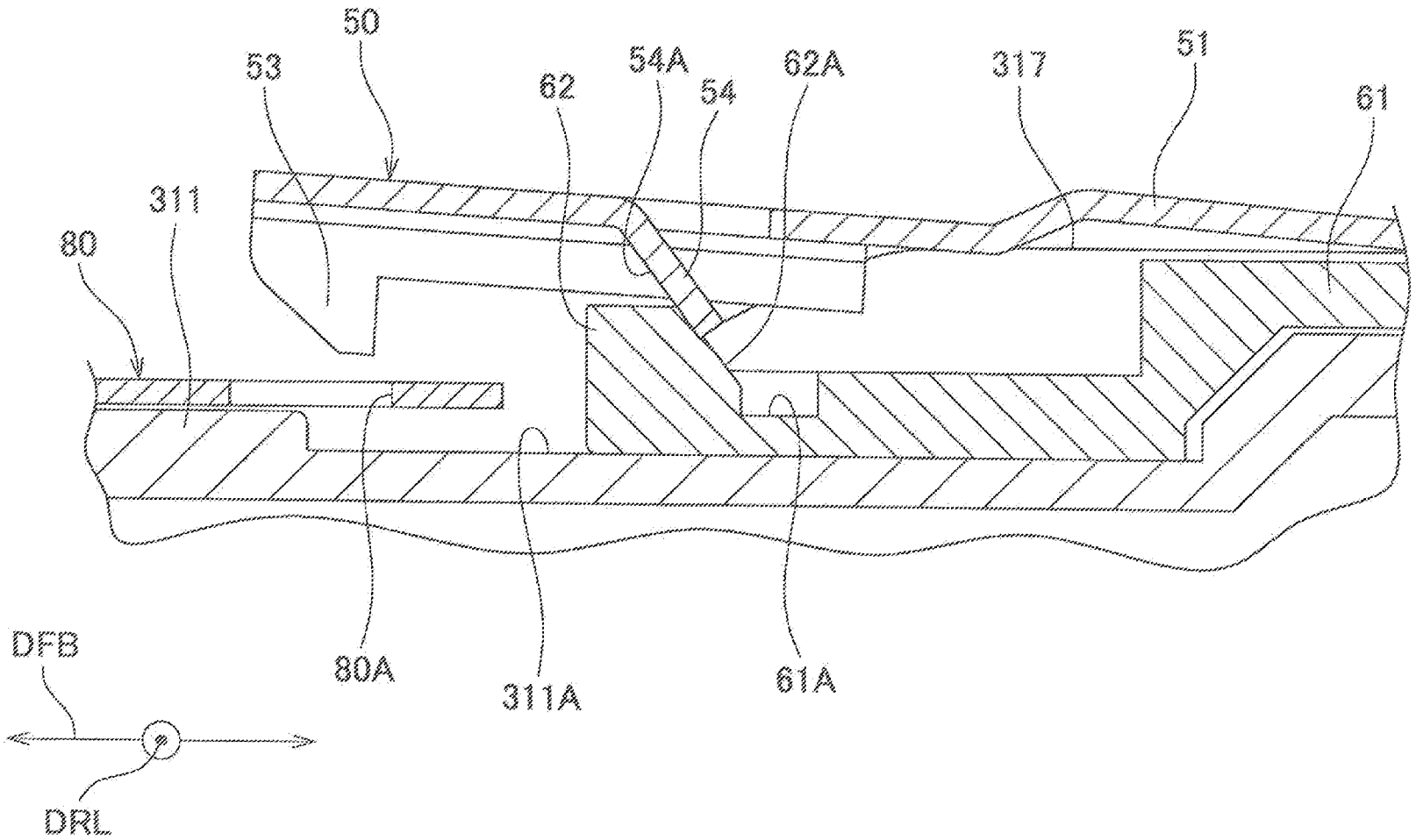
FIG. 7 is a partial cross-sectional view showing a state in which the connector shown in FIG. 1 is released from the state locked to the mating connector.
Figure 8:
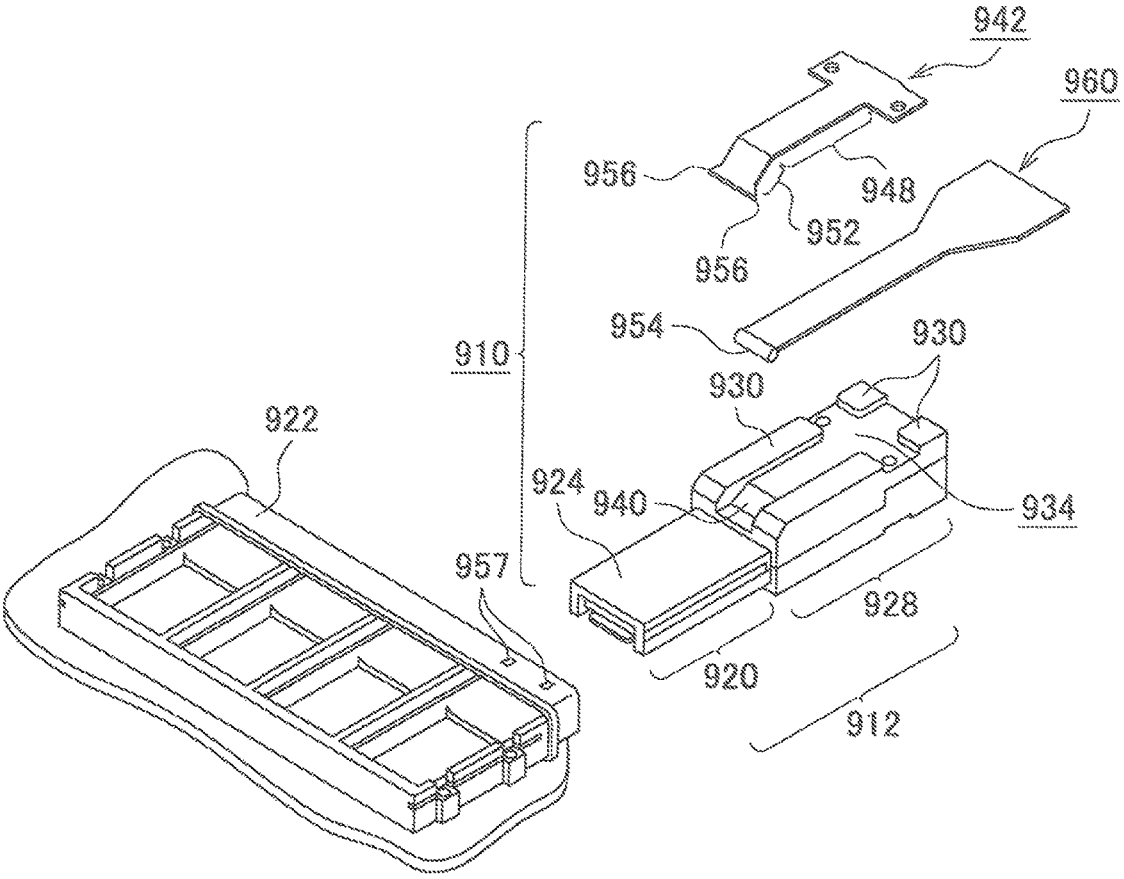
FIG. 8 PRIOR ART
FIG. 8 is an exploded perspective view of a conventional plug connector.
Figure 9:
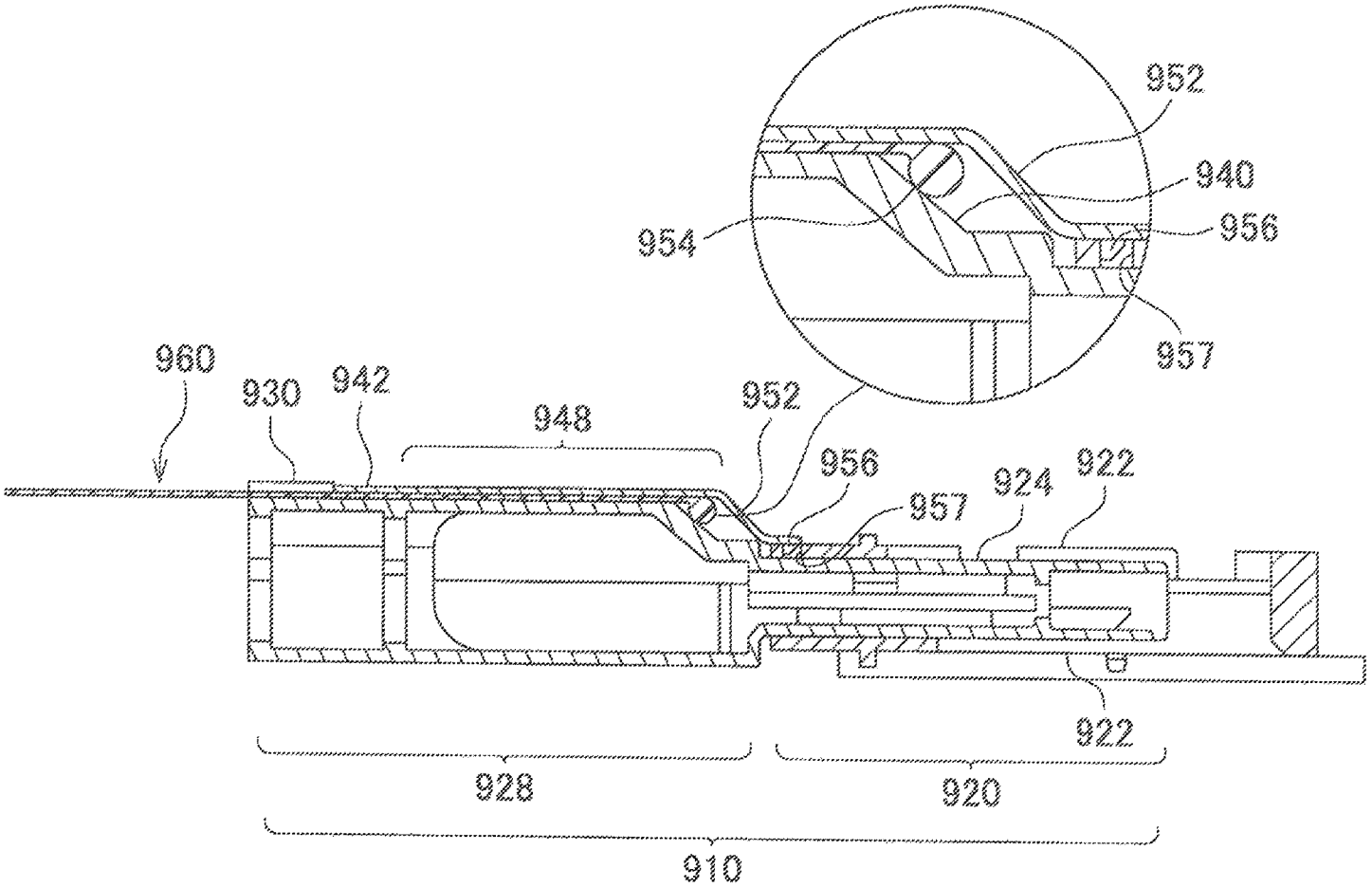
FIG. 9 PRIOR ART
FIG. 9 is a cross-sectional view of the plug connector shown in FIG. 8 inserted in a mating receptacle connector, illustrating one of hooks of a latch member hooked to a guide frame accommodating the receptacle connector.

As shown in FIGS. 1 to 5, a connector 10 is connected to a cable 75. The connector 10 can be fitted to a mating connector (only a mating housing 80 of the mating connector is shown in FIGS. 6 and 7) mounted on e.g. a printed substrate (not shown).

The connector 10 is comprised of a housing 30 which can be fitted to the mating housing 80 of the mating connector, a locking member 50 for maintaining a state of the housing 30 fitted to the mating housing 80, an operation member 60 for operating the locking member 50 such that a locked state in which the state fitted of the housing 30 to the mating housing 80 is maintained is released, and a printed substrate 70 supported by the housing 30. The operation member 60 is mounted on the housing 30 in a manner movable in a front-rear direction DFB of the housing 30.

The housing 30 is formed by an upper housing divided body 31 and a lower housing divided body 33. The upper housing divided body 31 and the lower housing divided body 33 are each made of metal, and hence have an electromagnetic shield function.

The upper housing divided body 31 includes an upper wall portion 311 and a pair of side wall portions 314. The upper wall portion 311 is formed with a recessed portion 311A. Disposed in the recessed portion 311A is a front-side portion of the operation member 60 including an operating portion 62, referred to hereinafter.

One of the side wall portions 314 is formed on one lateral side of the upper wall portion 311, and the other of the side wall portions 314 is formed on the other lateral side of the upper wall portion 311.

Figure 4:
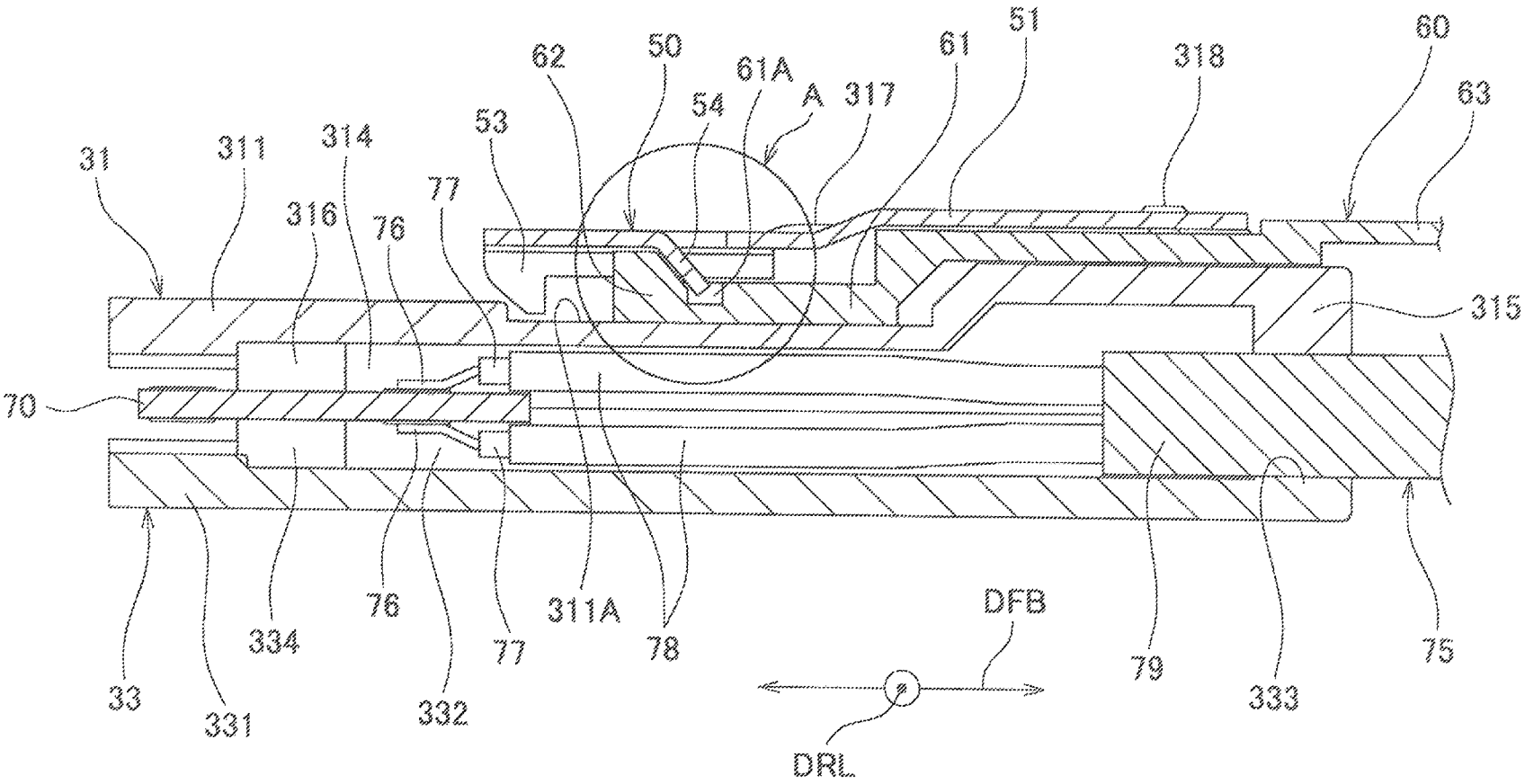
FIG. 4 is a cross-sectional view of the connector shown in FIG. 1.
Figure 5:
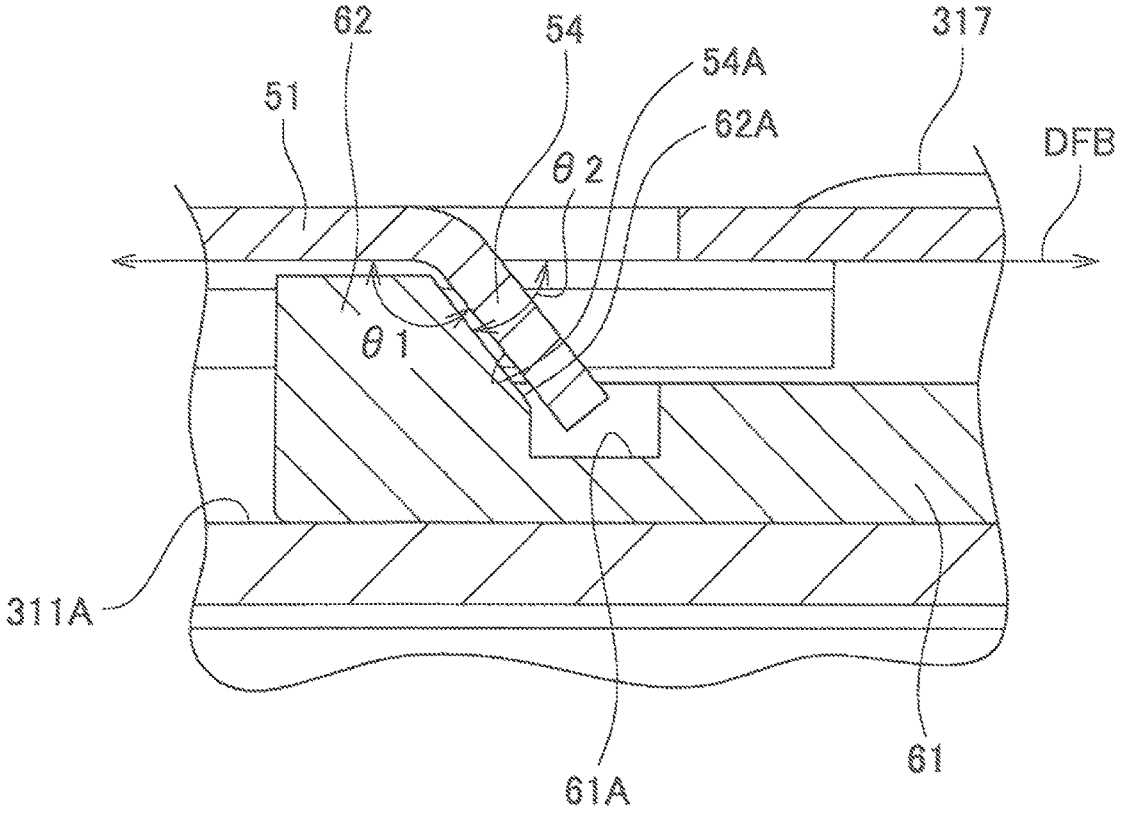
FIG. 5 is an enlarged view of part A appearing in FIG. 4.

A rear end portion of the upper housing divided body 31 has an inner surface formed with a cable holding portion 315 (see FIG. 4). A front end portion of each side wall portion 314 has an inner surface formed with a substrate retaining portion 316. The upper wall portion 311 has a top surface formed with two columnar rivets 318. Opposite side portions of the top surface of the upper wall portion 311 are formed with a pair of plate-shaped covering walls 317, each of which rises from the top surface, perpendicularly thereto. The pair of covering walls 317 are arranged in a manner sandwiching a rear-side portion of the upper wall portion 311 from a right-left direction DRL of the housing 30. Each covering wall 317 has a front end portion, formed with a stopper surface 317A which is perpendicular to the top surface of the upper wall portion 311. The stopper surfaces 317A receive retaining protrusions 64, referred to hereinafter, and restricts the backward movement of the operation member 60.

The lower housing divided body 33 includes a lower wall portion 331 and a pair of side wall portions 332. One of the side wall portions 332 is formed on one lateral side of the lower wall portion 331, and the other of the side wall portions 332 is formed on the other lateral side of the lower wall portion 331.

A rear end portion of the lower housing divided body 33 has an inner surface formed with a cable holding portion 333. A front end portion of each side wall portion 332 has an inner surface formed with a substrate supporting portion 334.

The locking member 50 includes a locking member body 51 which extends in the front-rear direction DFB, a fixing portion 52 located at a fixed end-side portion of the locking member body 51, a pair of hook-shaped hooking portions 53 located at respective free end-side portions of the locking member body 51, and a plate-shaped transmission portion 54. In the present embodiment, the locking member body 51, the fixing portion 52, the hooking portions 53, and the transmission portion 54 are integrally formed by blanking and bending a metal plate.

The locking member body 51 is mounted on the housing 30 in a cantilever manner. The fixing portion 52 is formed with two holes 52A (see FIG. 2) through which the two rivets 318 are inserted. The hooking portions 53 are hooked to the mating housing 80. The transmission portion 54 is formed between the fixing portion 52 and the hooking portions 53 of the locking member body 51. The transmission portion 54 has a flat surface (surface) 54A. In the present embodiment, an angle θ1 (see FIG. 5) formed between the flat surface 54A and the front-rear direction DFB is approximately 135 degrees.

The operation member 60 includes the operating portion 62 that applies a force to move the operation member 60 toward the rear of the housing 30 to the transmission portion 54 of the locking member 50, a pulling portion 63 for pulling the operating portion 62 toward the rear of the housing 30, a connection portion 61 that connects the operating portion 62 and the pulling portion 63, and the pair of retaining protrusions 64 formed on the opposite side surfaces of the operating portion 62.

The connection portion 61 is formed with an accommodating recess (accommodating space) 61A for accommodating a lower end portion of the transmission portion 54. The accommodating recess 61A is located rearward of the operating portion 62. The operating portion 62 has a flat surface (surface) 62A which can be brought into contact with the flat surface 54A of the transmission portion 54. In the present embodiment, an angle θ2 (see FIG. 5) formed between the flat surface 62A and the front-rear direction DFB is approximately 45 degrees.

Figure 1:
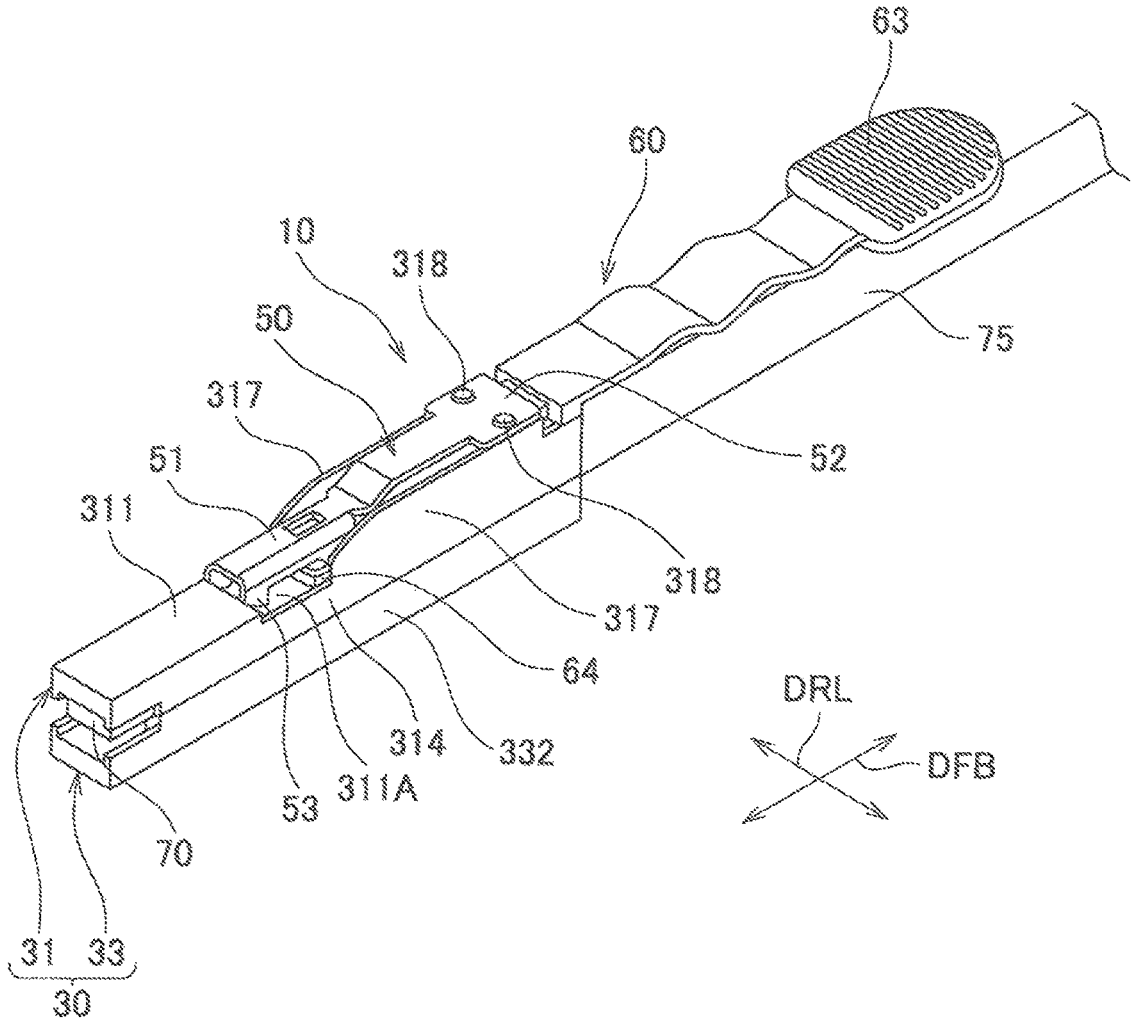
FIG. 1 is a perspective view of a connector according to an embodiment of the present invention.
Figure 2:
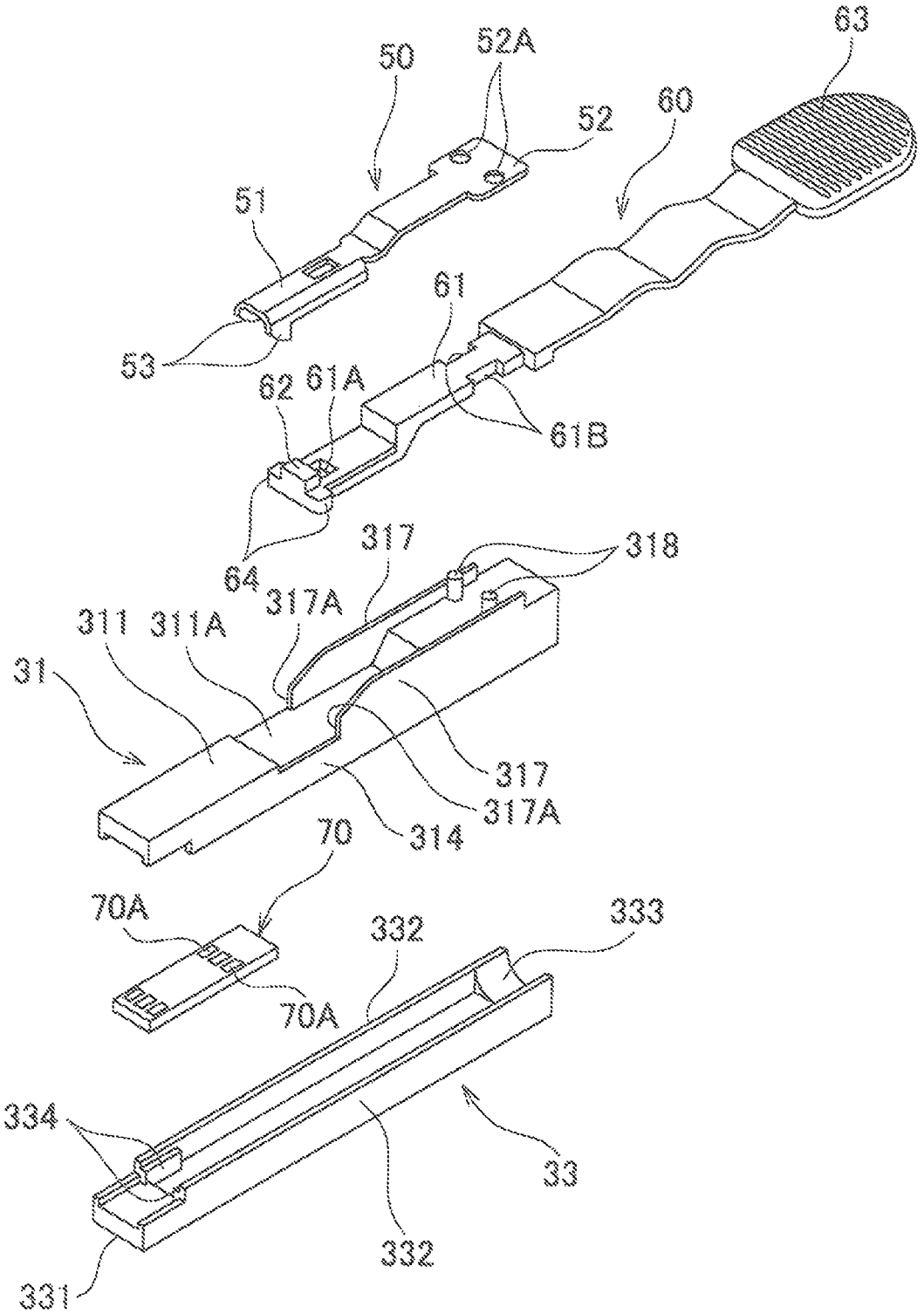
FIG. 2 is an exploded perspective view of the connector shown in FIG. 1.
Figure 3:
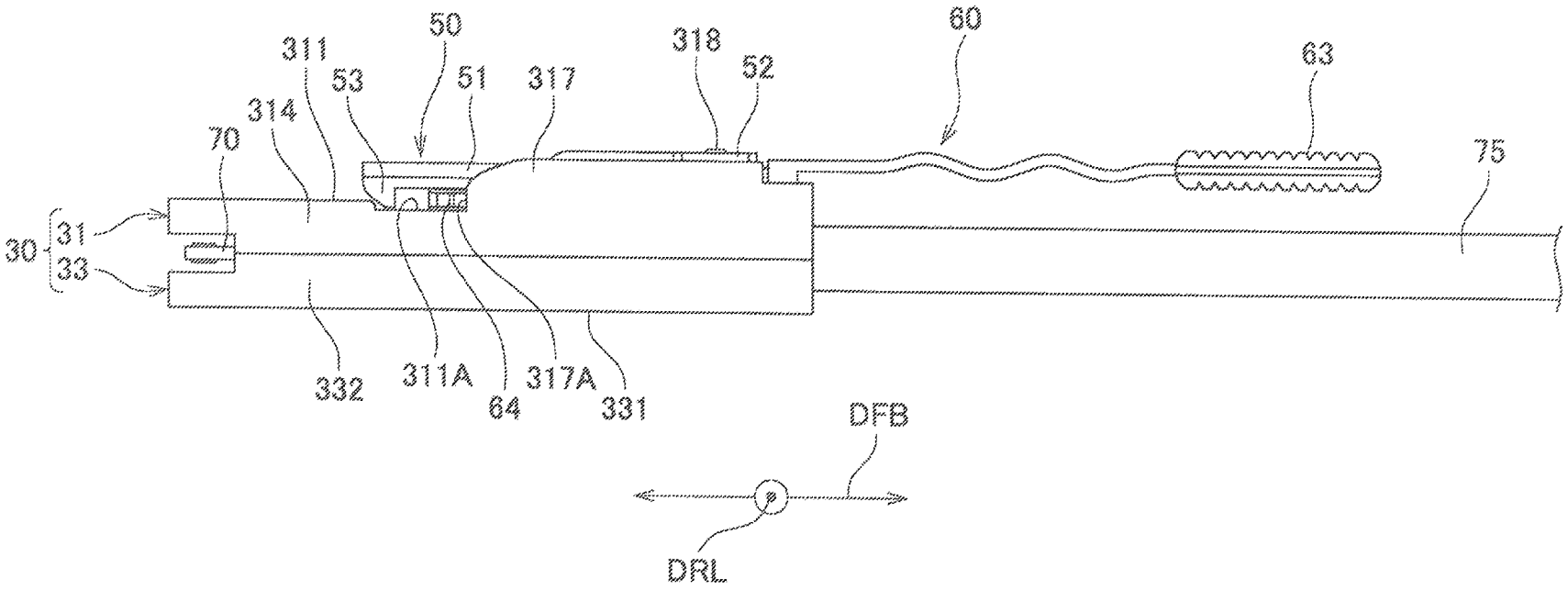
FIG. 3 is a side view of the connector shown in FIG. 1.

The connection portion 61 has opposite side surfaces each formed with a cutout 61B (see FIG. 2). The cutouts 61B prevent the rivets 318 from interfering with the connection portion 61 when the operation member 60 moves along the front-rear direction DFB.

The pulling portion 63 protrudes rearward from the housing 30.

The cable 75 includes, as shown in FIG. 4, a plurality of internal conductors 76, a plurality of insulation coverings 77 for covering the internal conductors 76, respectively, a plurality of bundling coverings 78 each for bundling a plurality of the insulation coverings 77 in parallel, one braid (not shown) for covering the plurality of bundling coverings 78, and an outer covering 79 for covering the one braid. The printed substrate 70 has a plurality of conductive paths 70A formed on each of opposite surfaces. Each conductive path 70A has an intermediate portion thereof insulation-covered, and only opposite end portions thereof exposed (see FIG. 2). Each conductive path 70A has one end thereof soldered to each internal conductor 76 of the cable 75.

Next, a description will be given of how to assemble the connector 10.

First, the printed substrate 70 to which the internal conductors 76 of the cable 75 are soldered is placed on the substrate supporting portions 334 of the lower housing divided body 33, and the outer covering 79 of the cable 75 is placed on the cable holding portion 333 of the lower housing divided body 33.

Next, the lower housing divided body 33 is covered with the upper housing divided body 31. As a result, the printed substrate 70 is sandwiched between the substrate supporting portions 334 and the substrata retaining portions 316, whereby the printed substrate 70 is held by the housing 30, and the outer covering 79 of the cable 75 is sandwiched between the cable holding portion 315 and the cable holding portion 333, whereby the cable 75 is held by the housing 30.

Then, the upper housing divided body 31 and the lower housing divided body 33 are connected using general connection means (e.g. rivets and plates).

Next, the operation member 60 is disposed on the upper housing divided body 31. At this time, the operation member 60 is set such that the operating portion 62 and the front-side portion of the connection portion 61 are accommodated in the recessed portion 311A of the upper housing divided body 31.

Then, the locking member 50 is disposed on the operation member 60. At this time, the locking member 50 is set such that the rivets 318 enter the holes 52A of the fixing portion 52.

Finally, tops of the rivets 318 protruding from the holes 52A are hammered or squeezed. As a result, the fixing portion 52 is fixed to the housing 30.

By performing the above processing steps, assembly of the connector 10 is completed.

Next, a description will be given of how to fit and remove the connector 10 to and from the mating connector.

To fit the connector 10 to the mating connector, it is only required to insert the housing 30 into the mating housing 80. At this time, the hooking portions 53 of the locking member 50 enter locking holes 80A of the mating housing 80, respectively, whereby the locked state of the connector 10 and the mating connector is maintained.

To remove the connector 10 from the mating connector, it is only required to pinch and pull the pulling portion 63 backward. When the pulling portion 63 is pulled backward, the operating portion 62 is moved backward along the front-rear direction DFB. At this time, a force to pull the pulling portion 63 backward is transmitted to the locking member body 51 via the flat surface 54A of the transmission portion 54 which is brought into contact with the flat surface 62A of the operating portion 62 as a force to push up the locking member body 51, and hence the locking member body 51 is elastically deformed upward, which causes the hooking portions 53 to slip out of the locking holes 80A of the mating housing 80. As a result, the locked state of the connector 10 and the mating connector is released, and the connector 10 is drawn out of the mating housing 80.

When the hand is released from the pulling portion 63, the locking member body 51 returns to a state before deformation by the returning force thereof, and the hooking portions 53 also return to the original position thereof. At this time, the returning force of the locking member body 51 is transmitted to the operating portion 62 of the operation member 60 via the transmission portion 54 of the locking member 50 to push the flat surface 62A of the operating portion 62 forward, and hence the operation member 60 also returns to the original position thereof.

When the operation member 60 is moved backward, the retaining protrusions 64 are brought into abutment with the stopper surfaces 317A of the covering walls 317, and hence the operation member 60 is prevented from moving backward by more than a predetermined amount.

According to the present embodiment, each of the flat surface 62A of the operating portion 62 of the operation member 60 and the flat surface 54A of the transmission portion 54 of the locking member 50 is a surface inclined toward the rear of the housing 30 in a manner approaching the housing 30, respectively, and it is possible to reduce the distance between the operating portion 62 of the operation member 60 and the hooking portions 53 of the locking member 50. Therefore, it is possible to reduce a dimension of the connector 10 in the front-rear direction.

Further, the operation member 60 is formed with the accommodating recess 61A for accommodating the lower end portion of the transmission portion 54 of the locking member 50, which eliminates the need of increasing the height of the operating portion 62, and hence it is possible to reduce a dimension of the connector 10 in a direction of the height thereof.

Although in the above-described embodiment, both of the part of the transmission portion 54 which is brought into contact with the operating portion 62 and the part of the operating portion 62 which is brought into contact with the transmission portion 54 are each formed with a surface inclined toward the rear of the housing 30 in a manner approaching the housing 30 (flat surfaces 54A and 62A in the present embodiment), for example, only one of the part of the transmission portion 54 which is brought into contact with the operating portion 62 and the part of the operating portion 62 which is brought into contact with the transmission portion 54 may be formed with a surface inclined toward the rear of the housing 30 in a manner approaching the housing 30.

Further, although in the above-described embodiment, the transmission portion 54 is formed with the flat surface 54A, and the operating portion 62 is formed with the flat surface 62A, the surfaces formed on the transmission portion 54 and the operating portion 62 are not limited to the flat surfaces, but for example, the surfaces may be formed into curved surfaces (e.g. convex surfaces, concave surfaces, or cylindrical surfaces).

Although the housing 30 and the locking member 50 are both made of metal, they may be made of resin.

Further, although the operation member 60 is made of resin, it may be made of metal.

Although in the above-described embodiment, the transmission portion 54 is formed in a central portion of the locking member body 51 (at a location corresponding to a center of the operation member 60 in the right-left direction DRL of the housing 30), the transmission portion 54 may be formed on one of the sides in the right-left direction DRL. In this case, the location of the operating portion 62 is changed according to the location of the transmission portion 54.

Further, although in the above-described embodiment, the operation member 60 includes the connection portion 61, the connection portion 61 is not necessarily required, but for example, the pulling portion 63 may be directly connected to the operating portion 62.

It is further understood by those skilled in the art that the foregoing are the preferred embodiments of the present invention, and that various changes and modification may be made thereto without departing from the spirit and scope thereof.

What is claimed is:

1. A connector including:

a housing that can be fitted to a mating connector, a locking member mounted on the housing, for maintaining the housing in a state fitted to the mating connector, and an operation member mounted on the housing in a manner movable along a front-rear direction of the housing, for operating the locking member such that a locked state in which the fitted state of the housing to the mating connector is maintained is released, wherein the locking member comprises:

a locking member body that is mounted on the housing in a cantilever manner;

a fixing portion that is provided at a fixed end-side portion of the locking member body, and is fixed to the housing;

a hooking portion provided at a free end-side portion of the locking member body, for being hooked to the mating connector to thereby maintain the locked state; and a transmission portion provided between the fixing portion and the hooking portion of the locking member body, for transmitting a force to move the operation member toward a rear of the housing, which is a direction away from the mating connector, to the locking member body, causing elastic deformation of the locking member body, thereby displacing the hooking portion in a direction away from the mating connector, to release the locked state, wherein the operation member comprises an operating portion that applies the force to move the operation member toward the rear of the housing to the transmission portion, and wherein at least one of a portion of the transmission portion, which is brought into contact with the operating portion, and a portion of the operating portion, which is brought into contact with the transmission portion, is formed with a surface inclined in a manner approaching the housing as the surface extends toward the rear of the housing.

2. The connector according to claim 1, wherein the surface is a flat surface.

3. The connector according to claim 1, wherein the locking member is integrally formed by bending a plate-shaped member.

4. The connector according to claim 2, wherein the locking member is integrally formed by bending a plate-shaped member.

5. The connector according to claim 1, wherein the operation member includes a pulling portion for pulling the operating portion toward the rear of the housing.

6. The connector according to claim 2, wherein the operation member includes a pulling portion for pulling the operating portion toward the rear of the housing.

7. The connector according to claim 3, wherein the operation member includes a pulling portion for pulling the operating portion toward the rear of the housing.

8. The connector according to claim 4, wherein the operation member includes a pulling portion for pulling the operating portion toward the rear of the housing.

9. The connector according to claim 5, wherein the operation member includes a connection portion that connects the operating portion and the pulling portion, and wherein the connection portion is formed with an accommodating space for accommodating part of the transmission portion.

10. The connector according to claim 6, wherein the operation member includes a connection portion that connects the operating portion and the pulling portion, and wherein the connection portion is formed with an accommodating space for accommodating part of the transmission portion.

11. The connector according to claim 7, wherein the operation member includes a connection portion that connects the operating portion and the pulling portion, and wherein the connection portion is formed with an accommodating space for accommodating part of the transmission portion.

12. The connector according to claim 8, wherein the operation member includes a connection portion that connects the operating portion and the pulling portion, and wherein the connection portion is formed with an accommodating space for accommodating part of the transmission portion.

13. The connector according to claim 9, wherein the operating portion, the connection portion, and the pulling portion are integrally formed of the same material.

14. The connector according to claim 10, wherein the operating portion, the connection portion, and the pulling portion are integrally formed of the same material.

15. The connector according to claim 11, wherein the operating portion, the connection portion, and the pulling portion are integrally formed of the same material.

16. The connector according to claim 12, wherein the operating portion, the connection portion, and the pulling portion are integrally formed of the same material.

* * * * *